US010035682B2

(12) United States Patent
Mikkonen et al.

(10) Patent No.: US 10,035,682 B2
(45) Date of Patent: Jul. 31, 2018

(54) APPARATUS FOR FIXING A HOISTING MACHINE OF AN ELEVATOR AND A FIXING ARRANGEMENT

(71) Applicants: Janne Mikkonen, Jarvenpaa (FI); Matti Räsänen, Hyvinkaa (FI); Esa Suorsa, Hyvinkaa (FI); Markku Häivälä, Hyvinkaa (FI); Markku Haapaniemi, Helsinki (FI); Esko Aulanko, Kerava (FI)

(72) Inventors: Janne Mikkonen, Jarvenpaa (FI); Matti Räsänen, Hyvinkaa (FI); Esa Suorsa, Hyvinkaa (FI); Markku Häivälä, Hyvinkaa (FI); Markku Haapaniemi, Helsinki (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 1042 days.

(21) Appl. No.: 14/339,942

(22) Filed: Jul. 24, 2014

(65) Prior Publication Data

US 2014/0332326 A1 Nov. 13, 2014

Related U.S. Application Data

(63) Continuation of application No. PCT/FI2013/050082, filed on Jan. 25, 2013.

(30) Foreign Application Priority Data

Jan. 27, 2012 (FI) ..... 20125084

(51) Int. Cl.
*B66B 11/00* (2006.01)

(52) U.S. Cl.
CPC ..... *B66B 11/0045* (2013.01)

(58) Field of Classification Search
CPC ..... B66B 11/0045
(Continued)

(56) References Cited

U.S. PATENT DOCUMENTS 6,991,069 B1 * 1/2006 Ach ..... B66B 7/027 187/254
7,775,325 B2 * 8/2010 Liebetrau ..... B66B 19/007 187/254

(Continued)

FOREIGN PATENT DOCUMENTS

CN 1257821 A 6/2000
CN 1623883 A 6/2005

(Continued)

OTHER PUBLICATIONS

Chinese Office Action issued in corresponding Chinese Patent Application No. 201380006765, dated Nov. 2, 2015.

(Continued)

*Primary Examiner* — William E Dondero
*Assistant Examiner* — Diem M Tran
(74) *Attorney, Agent, or Firm* — Harness, Dickey & Pierce, P.L.C.

(57) ABSTRACT

An apparatus for fixing a hoisting machine in an elevator includes a machine station configured to arrange a traction sheave of the elevator, a motor and a plurality of diverting pulleys for one or more traction members into position relative to each other. A fixing arrangement for fixing a hoisting machine in an elevator includes a machine station and a plurality of brackets. The plurality of brackets fix the machine station into a final position, which is determined by a position of guide rails in the elevator hoistway.

20 Claims, 6 Drawing Sheets

Figure 1:
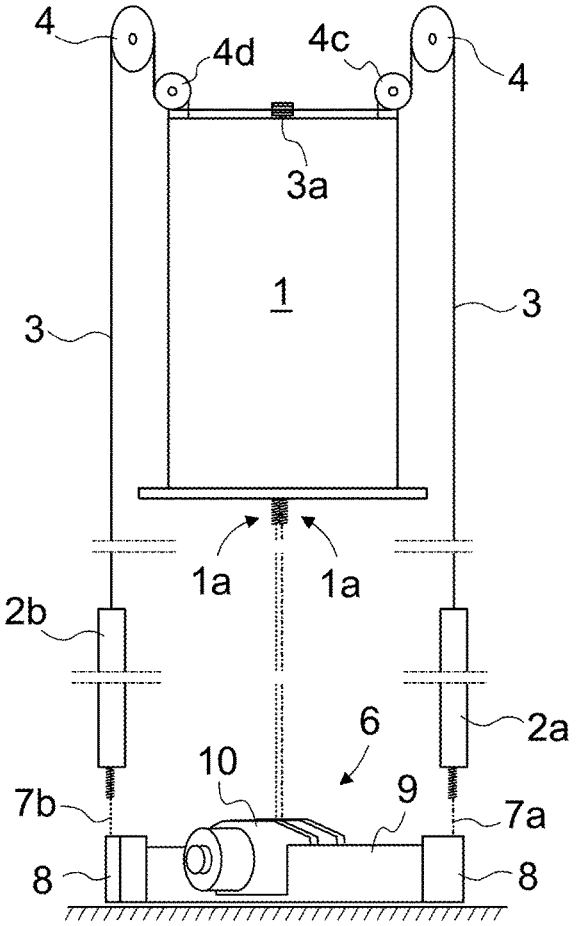

(58) Field of Classification Search
USPC ..... 187/406, 408
See application file for complete search history.

(56) References Cited

U.S. PATENT DOCUMENTS

| | | | | |
|---|---|---|---|---|
| 8,302,740 | B2 * | 11/2012 | Swaybill | B66B 7/08 187/254 |
| 2011/0132695 | A1 | 6/2011 | Aziz et al. | |

FOREIGN PATENT DOCUMENTS

| | | | | |
|---|---|---|---|---|
| CN | 1649790 | A | 8/2005 | |
| CN | 2926156 | Y | 7/2007 | |
| EP | 1327597 | A1 | 7/2003 | |
| EP | 1500620 | A1 | 1/2005 | |
| ES | 2161183 | A1 | 11/2001 | |
| FR | 2813874 | A1 | 3/2002 | |
| JP | 2000247559 | A | 9/2000 | |
| JP | 2001048450 | A | 2/2001 | |
| JP | WO 02098782 | A1 * | 12/2002 | B66B 11/0045 |
| JP | WO 2004022471 | A1 * | 3/2004 | B66B 11/0045 |
| JP | WO 2009034630 | A1 * | 3/2009 | B66B 11/0045 |
| WO | WO-03043927 | A2 | 5/2003 | |
| WO | WO-2006010785 | A1 | 2/2006 | |

OTHER PUBLICATIONS

Extended European Search Report dated Oct. 28, 2015, issued in European Application No. 13741110.
International Search Report PCT/ISA/210 for International Application No. PCT/FI2013/050082 dated May 24, 2013.
Written Opinion of the International Searching Authority PCT/ISA/237 for International Application No. PCT/FI2013/050082 dated May 28, 2013.
Finnish Search Report for FI20125084 dated Nov. 22, 2012.

* cited by examiner

APPARATUS FOR FIXING A HOISTING MACHINE OF AN ELEVATOR AND A FIXING ARRANGEMENT

This application is a continuation of PCT International Application No. PCT/FI2013/050082 which has an International filing date of Jan. 25, 2013, and which claims priority to Finnish patent application number 20125084 filed Jan. 27, 2012, the entire contents of both which are incorporated herein by reference.

The object of the invention is an apparatus for fixing a hoisting machine of an elevator and a fixing arrangement.

Although hereinafter only compensating weights and the guide rails of them are almost exclusively mentioned in connection with application of the inventive solution, also the counterweights, and their guide rails, of elevators can just as well be used in the solution according to the invention, which concept can also be understood to belong to the inventive concept of the solution.

According to prior art an elevator machine is installed into its position as separate parts, e.g. in such a way that at first the precise positions of the guide rails of the elevator car are measured and marked and generally the car guide rails are also fixed into position. After that the other components that belong in connection with the elevator machine can be disposed in the correct positions in relation to the car guide rails. Before disposing the machine in its position, the machine bedplate is installed in its position in relation to the car guide rails, after which the elevator machine, with its traction sheave and diverting pulleys, is installed, and so on until all the necessary components are disposed in their correct positions. Installation work of this kind is extremely time-consuming, because a lot of measuring and plumbing is needed for getting the components precisely into their correct positions. Additionally, measuring errors often also occur, which can result in the elevator installation not functioning in the best possible way, and installation errors and measuring errors can cause damage to the elevator structures as well as produce noise problems and other problems. The additional repairs needed cause operating disruptions and extra costs.

A template can also be used as an aid, which template is first placed on the base of the hoistway and the components are then disposed on top of the template in the positions indicated by the template. Even this solution, however, is not necessarily sufficiently reliable in relation to the precision of the end result, and it is time-consuming, and also much error-prone measuring and plumbing must be performed in this solution also.

The aim of the present invention is to eliminate the aforementioned drawbacks and to achieve an inexpensive apparatus, which can be precisely and rapidly installed and that is easily implemented, for installing and fixing a hoisting machine of an elevator. Another aim is to achieve a type of fixing arrangement to be used in the installation of an elevator, wherein the hoisting machine of the elevator, with its components, and the guide rails of the elevator car can be easily interpositioned with each other in such a way that after the plumbing of the guide rails of the car other measurements and plumbings are not necessarily needed. In this case the locations of the elevator machine and of the components of the elevator in the layout of the elevator are automatically determined on the basis of the location of the guide rails of the elevator car as well as on the basis of the shape, dimensioning and manufacturing tolerances of the machine station according to the invention and of the machine station brackets as well as of the guide rail brackets.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can in at least some suitable situations be deemed to be inventive in their own right.

One advantage, among others, of the solution according to the invention is that by means of it the rapid, easy and reliable installation of an elevator machine precisely into its own position is enabled without time-consuming measuring and plumbing. In this case one advantage is that in the installation errors do not occur in the location position of the elevator machine and of the elevator components, but instead all the location positions are automatically determined on the basis of the location of the guide rails of the elevator car as well as on the basis of the shape, dimensioning and manufacturing tolerances of the machine station and of the machine station brackets as well as of the guide rail brackets. Another advantage is that since no fixings need to be made in the floor of the hoistway, the solution according to the invention can also be used in old elevator hoistways, in which the resilience of the floor is not certain. Another advantage is cost savings enabled by the solution, owing to the speed and ease of installation. Preferably when fabricating an elevator according to the invention, before installation it must only be checked that the intended elevator fits into the elevator hoistway and possibly also a suitable location must be sought in the elevator hoistway for disposing the substructure of the elevator.

According to the basic concept of the invention, an elevator comprising an elevator car and one or more counterweights or compensating weights suspended by at least one suspension member, such as a rope or a belt, and moved by a traction member, e.g. a belt, that is separate from the suspension member and driven by at least one traction sheave, comprises a machine station, wherein the locations of the traction sheave and the motor or machine rotating the traction sheave, and the passage of the traction member are positioned e.g. by the aid of one or more diverting pulleys. Preferably the machine station is fixed to a bracket or corresponding, which positions the location of the guide rail of the elevator car, even more preferably to brackets or corresponding, which position the locations of the guide rails of the elevator car. Very advantageously the brackets or corresponding and the machine station together determine the interpositioning of the traction sheave and the motor or machine rotating the traction sheave, and the traction member and the guide rails of the elevator car. The brackets or corresponding for positioning the location of the guide rail of the elevator car can also be used to fix the machine bedplate into its position. The machine bedplate can in this way be fixed e.g. to the walls or floor, or otherwise, of the elevator hoistway.

In practice a fairly advantageous method is to fix at least one, possibly two or more, bottom parts of the guide rails belonging to the elevator into their position and then to use one or more of the guide rails thus fixed as an aid in configuring the location of the machine station.

Fixing to the wall or to the guide rails or to some other rigid structure, e.g. via separate brackets or fasteners, is well suited for fixing the machine station into its position. In a glass hoistway or one of lightweight structure, for example, the supporting of the machine station can be arranged entirely by the aid of the elevator guide rails or counterweight guide rails. Instead of supporting directly on an elevator guide rail or counterweight guide rail, the supporting can also be arranged by the aid of a fixing means, such as e.g. a wall bracket, that is common to a guide rail and to the machine station.

Figure 2:
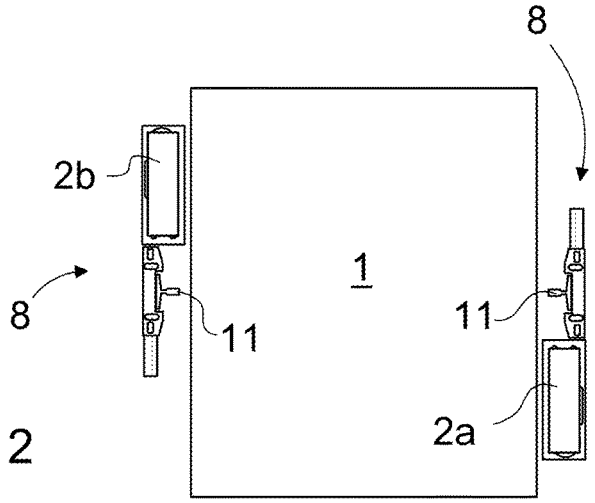
Figure 3:
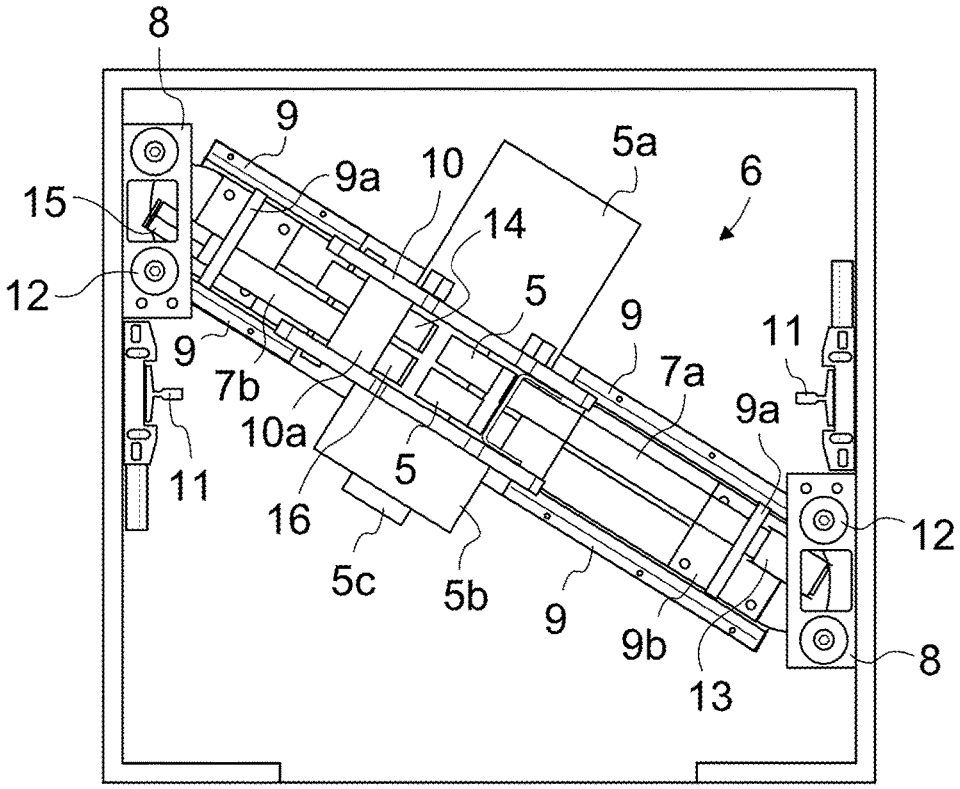
Figure 4:
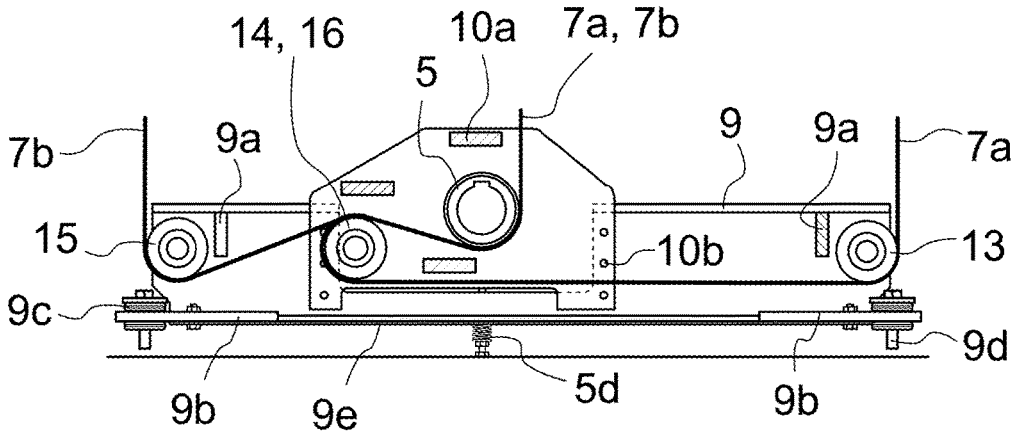
Figure 5:
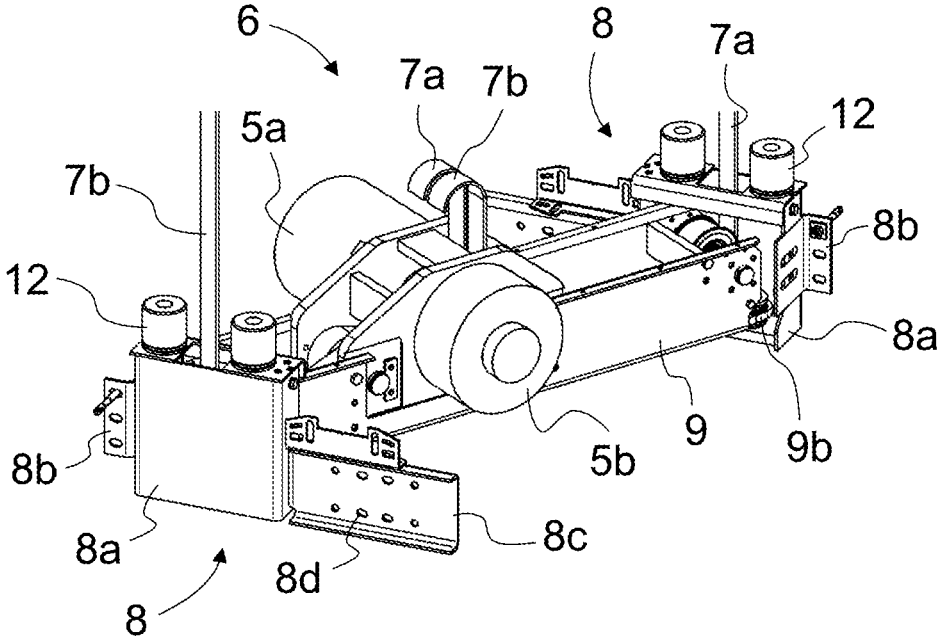
Figure 6:
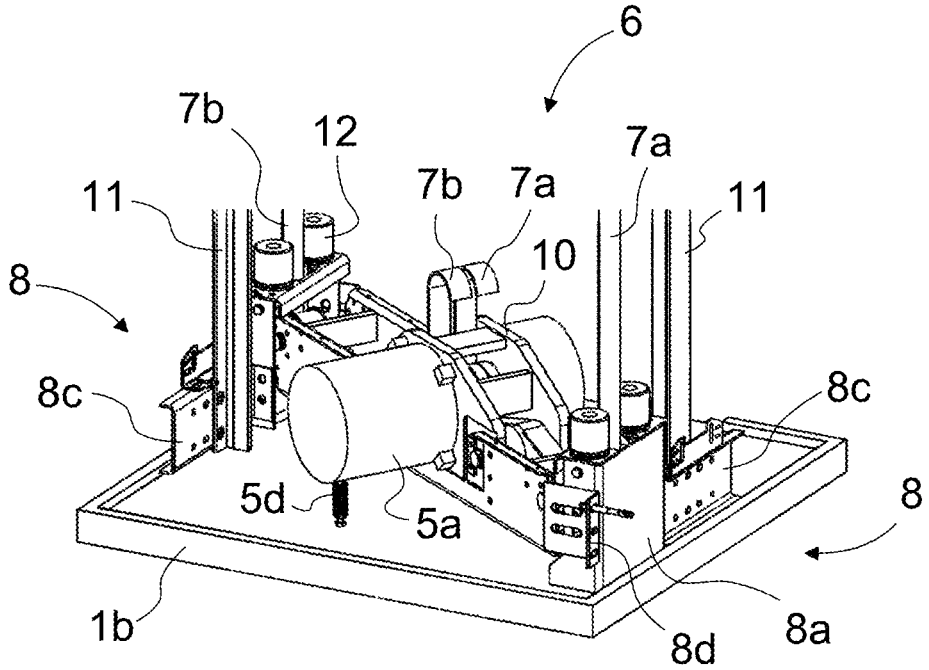
Figure 7:
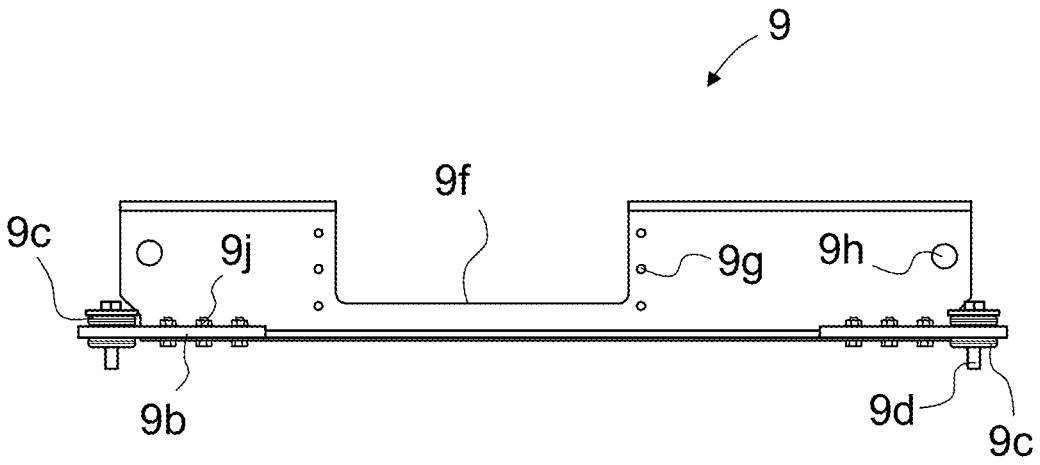
Figure 8:
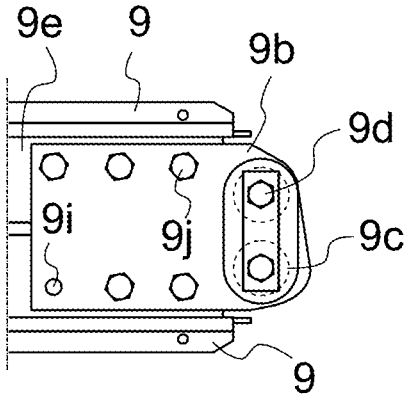
Figure 8A:
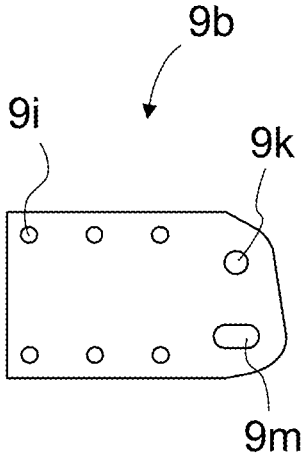
Figure 9:
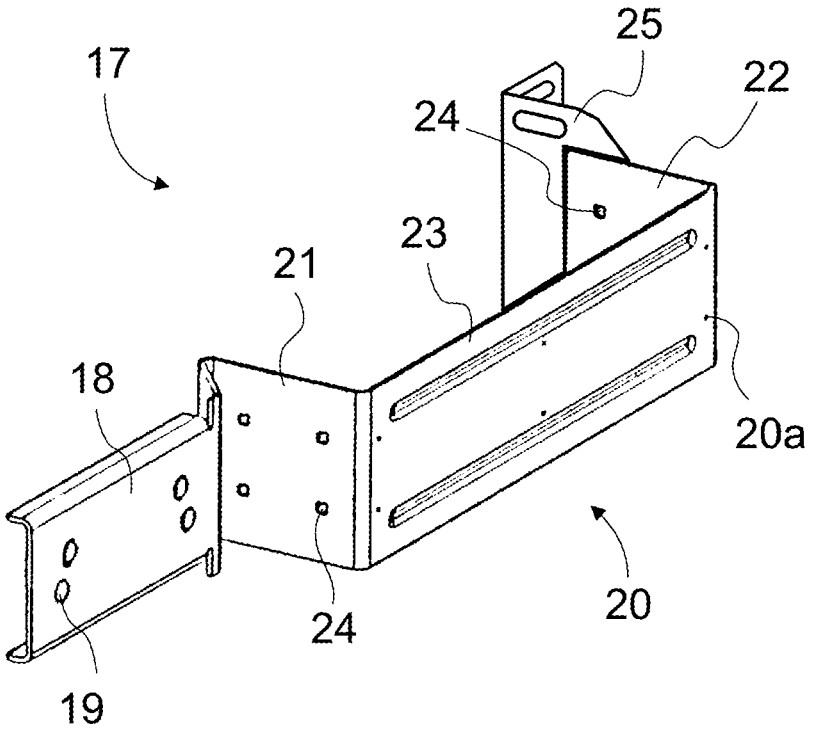
Figure 10:
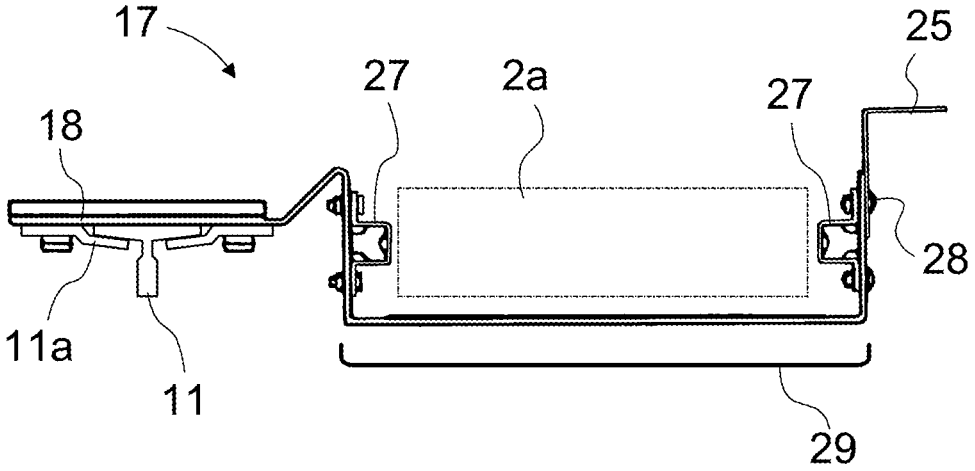
Figure 11:
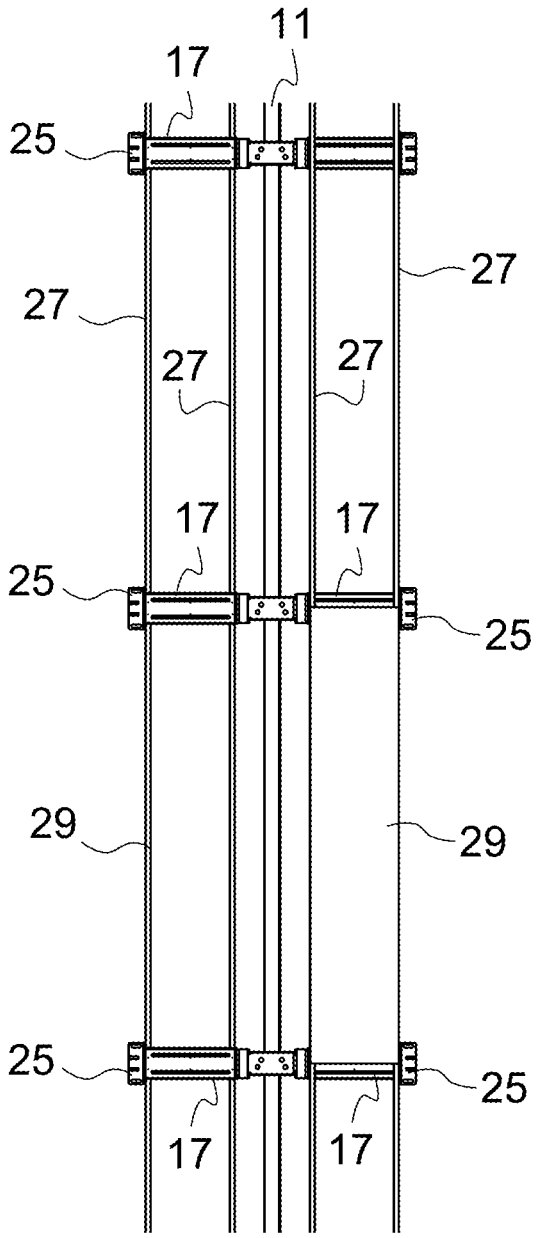

In the following, the invention will be described in more detail by the aid of some examples of its embodiment with reference to the simplified and diagrammatic drawings attached, wherein FIG. 1 presents a simplified and diagrammatic side view of one elevator arrangement according to the invention, provided with at least two compensating weights, wherein the hoisting machine of the elevator is disposed in the bottom part of the elevator hoistway, or close to it, FIG. 2 presents a simplified and diagrammatic top view of one elevator arrangement according to FIG. 1, wherein the compensating weights are disposed on different sides of the guide rail line of the elevator car to each other and on different sides of the elevator car, FIG. 3 presents a simplified top view of a machine station of the elevator arrangement according to FIG. 1 installed into its position in the bottom part of the elevator hoistway, FIG. 4 presents the machine station according to FIG. 3 as viewed directly from the side, sectioned from the center and without the brackets of the machine station, FIG. 5 presents an oblique view from the top and one side direction of the machine station according to FIG. 3, with brackets, FIG. 6 presents an oblique view from the top and a second side direction of the machine station according to FIG. 3, with brackets, FIG. 7 presents a simplified side view of one frame beam of the frame part of a machine station, the bottom part and the fixing part, with fixing means, of the machine station, FIG. 8 presents a top view of one end of a frame part of a machine station and the fixing part, with fixing means, of the machine station, FIG. 8*a* presents a top view of the fixing plate, without fixing means, of the machine station presented in FIG. 8, FIG. 9 presents an oblique view from the top and side of one guide rail bracket, provided with a wall bracket, to be used higher up in the elevator hoistway in the solution according to the invention, FIG. 10 presents a top view of a compensating weight, the detached cover plate of the compensating weight, said cover plate to be disposed in front of the path of travel of the compensating weight, and also a guide rail bracket according to FIG. 9 provided with elevator car guide rails, compensating weight guide rails and with a wall bracket, and FIG. 11 presents, as viewed from the direction of the side wall of the elevator hoistway, three guide rail clamps, in position, and a part of both the compensating weight guide rails and of the car guide rails of the elevator.

The solution according to the invention comprises at least an elevator car 1 configured to move reciprocally in an elevator hoistway and at least one or more counterweights or compensating weights 2*a*, 2*b*, which are for their part connected to support the elevator car 1 by the aid of suspension members 3, such as belts or ropes, and also by the aid of e.g. diverting pulleys 4 in the top part of the elevator hoistway, e.g. mounted on bearings on the guide rails 11 of the elevator car 1. In addition, the fixing arrangement according to the invention comprises a machine station 6, with its brackets 8, that is provided with at least one traction sheave 5 or corresponding and with a hoisting motor 5*a*, with a brake 5*b*, with an encoder 5*c* as well as with other components needed for the hoisting machine, to which brackets 8 the lowest wall bracket functioning as a fixing part 8*c* of the guide rail 11 of the elevator car is also preferably connected. Means enabling a weighing function are also preferably connected to the joint between the brake 5*b* and the frame of the machine station 6.

Likewise, the fixing arrangement according to the invention also comprises at least one or more traction members 7*a*, 7*b*, such as ropes or belts, that are fully separate from the suspension members 3, which traction members are configured to transmit the rotational movement of the traction sheave 5 into linear movement of the elevator car 1 and of the compensating weights 2*a*, 2*b*. Characteristic to the invention, and common to the preferred embodiments of the invention, is that two compensating weights 2*a*, 2*b*, or in some cases more than two compensating weights, are connected by the aid of their own traction member 7*a*, 7*b* provided with e.g. essentially spring tensioning or constant-force tensioning to most preferably one and the same hoisting machine in the machine station 6.

In addition, a rope clamp 3*a* or corresponding locking means is fixed to the top part of the elevator car 1, with which rope clamp each suspension member 3 is locked into position on the top part of the elevator car 1, e.g. during servicing work on the elevator.

The aforementioned two or more compensating weights 2*a*, 2*b* enable an essentially easy layout in elevator design. At the same time the layout also brings various space benefits. In this case one layout solution can be e.g. the type of layout in which, when viewed from above, at the center of the elevator hoistway is a plane formed by the car guide rails 11 of the elevator and around this plane are four corners for different structural solutions. For example, two corners are used for the compensating weights 2*a*, 2*b* and their guide rails 27, one corner is used for safety devices, mainly e.g. for an overspeed governor, and one corner is used for other devices, such as for the trailing cables, et cetera.

FIG. 1 presents a simplified and diagrammatic side view of one elevator arrangement provided with at least two compensating weights, in which elevator arrangement a machine station 6 according to the invention and its fixing arrangement are used, and FIGS. 2 and 3 present simplified top views of an elevator arrangement according to FIG. 1, in the bottom part of the elevator hoistway, and also FIG. 4 presents the machine station according to FIG. 3 as viewed directly from the side, sectioned from the center, simplified, and without the brackets 8 of the machine station 6.

FIG. 2 presents a top view of one arrangement according to the invention for disposing the compensating weights 2*a*, 2*b* in the elevator hoistway. In FIG. 3 the compensating weights 2*a*, 2*b* are disposed on opposite sides of the elevator car 1 and on different sides of the guide rail line of the elevator car 1 to each other, in which case the suspension of the elevator car 1 and of the compensating weights 2*a*, 2*b* is very symmetrical and does not produce any additional stresses e.g. on the guide rails 11 of the elevator car. This is an extremely advantageous layout option if it is only possible.

The elevator arrangement according to FIGS. 1-4 comprises two compensating weights 2*a* and 2*b*, both of which are connected to the elevator car 1 by the aid of common suspension members 3. There can be one suspension member 3 or a number of them side by side. The suspension member 3 is fixed at its first end to a first compensating weight 2*a* functioning as a counterweight, and passes over a first diverting pulley 4 in the top part of the elevator hoistway or in the machine room and onwards above the elevator car 1 under the diverting pulleys 4*c* and 4*d* disposed on the elevator car 1, and ascends upwards again and passes over a second diverting pulley 4 in the top part of the elevator hoistway or in a machine room and descends downwards to a second compensating weight 2*b* functioning as a counterweight, to which compensating weight the suspension member 3 is fixed at its second end. The diverting pulleys 4 are preferably disposed e.g. on the top ends of the guide rails 11 of the elevator car 1, in which case the guide rails 11 take the forces produced by moving the elevator car e.g. via their guide rail brackets into the walls of the elevator hoistway or into other strong structures. There are, however, also other suitable location position points.

A machine station 6 comprising a hoisting machine and means connected to it, said machine station being provided with a one-piece or two-piece traction sheave 5, is configured to move the elevator car 1, which machine station is preferably e.g. of modular structure and is disposed supported on its brackets 8 in the bottom part of the elevator hoistway, e.g. on the base of the elevator hoistway or right in the proximity of the base. In this case installation of the machine station 6 is easy, and long electric cables from the bottom part of the building to the hoisting machine and to the control cabinet are not needed. Additionally, at least one humidity sensor, which is arranged to issue an alarm and if necessary to stop the elevator if excessive water comes onto the base of the hoistway, is disposed on the base of the hoistway. In this way the elevator machine and the electrical components of the elevator can be protected from excessive humidity.

From FIG. 3 it is seen that the modular machine station 6 with hoisting machine, support structures and diverting pulleys 13-15 and with its traction sheave 5, is at some certain angle with respect to the mutual guide rail line of the guide rails 11 of the elevator car 1. This angle can vary, depending on the respective elevator layout solution. The machine station 6, with associated support structures is fixed at its ends to brackets 8, which are further fixed e.g. to the wall of the elevator hoistway in such a way that the wall structures receive the forces produced by moving the elevator car. The top surface of the brackets 8 also comprises buffers 12 for the compensating weights 2*a*, 2*b*.

The support structure of the machine station 6 is composed of e.g. two parallel frame beams 9 that are at a distance from each other and in the longitudinal direction of the machine station 6, the structure of which frame beam 9 is described in more detail in FIGS. 7-8, and of two parallel frame plates 10 of the motor 5*a* that are at a distance from each other and in the longitudinal direction of the machine station 6 and are fixed to the frame beams 9, of which the first frame plate is fixed e.g. with bolts and nuts to a first frame beam 9 of the machine station 6 and the second is fixed e.g. with bolts and nuts to a second frame beam 9 of the machine station 6. The frame plates 10 of the motor also have precisely dimensioned and positioned holes for the shafts of the traction sheave 5 and of the diverting pulleys 14, 16 as well as fixing holes 10*b* for fixing the frame plates 10 precisely into their correct location on the frame beams 9.

The frame beams 9 and the frame plates 10 of the motor are additionally supported on each other by the aid of support plates 9*a* and 10*a*, of which support plates for the sake of clarity not all are presented in the figures. The guide rails 11 of the elevator car 1 are fixed at their bottom ends to the same brackets 8, which are made to be dimensionally precise in such a way that the guide rails 11 can be easily and precisely positioned in their correct locations, after which the entire machine station 6, with all its components, is in precisely the correct location position with regard to the operation of the whole elevator. In this case the positioning of the machine station 6 is determined according to the location of the guide rail 11 of the elevator car 1 and the fixing parts of the machine station 6 without separate plumbing at the same time as only the guide rails 11 are plumbed.

The passage of the traction members 7*a*, 7*b* on the diverting pulleys and traction sheaves of the machine station 6 is seen from FIG. 4. For each compensating weight separately its own traction member 7*a*, 7*b* is disposed between the bottom part of the compensating weights 2*a*, 2*b* and the bottom part of the elevator car 1, which traction member receives its movement transmission force from the traction sheave 5 of the hoisting machine of the machine station 6, said traction sheave rotating on an essentially vertical plane. The first traction member 7*a* is fixed at its first end to a first compensating weight 2*a*, is configured to leave the compensating weight 2*a* and go downwards and is led to pass around the bottom of a first diverting pulley 13 on a first side of the traction sheave 5, after which the traction member 7*a* is led past the traction sheave 5 of the hoisting machine of the machine station 6 fitted below the elevator car 1 below the traction sheave 5 from the first side to the second side of the traction sheave and onwards below a second diverting pulley 14 on the second side of the traction sheave 5 and disposed in connection with the hoisting machine, around the diverting pulley and back towards the traction sheave 5 of the hoisting machine, after passing around the bottom of which the traction member 7*a* is led upwards from the first side of the traction sheave 5 to a fixing point in connection with the elevator car 1, to which fixing point the second end of the traction member 7*a* is fixed.

Correspondingly, the second traction member 7*b* is configured to travel from the second compensating weight 2*b* via the traction sheave 5 to the elevator car 1 in such a way that the second traction member 7*b* is fixed at its first end to the second compensating weight 2*b*, is configured to leave the compensating weight 2*b* and go downwards and is led to pass around the bottom of at least one third diverting pulley 15 on the second side of the traction sheave 5, after which the traction member 7*b* is led over a fourth diverting pulley 16 on the second side of the traction sheave 5 to the traction sheave 5 of the hoisting machine disposed below the elevator car 1 from the second side of the traction sheave 5 and is configured to pass around the bottom of the traction sheave 5 and to ascend after this from the first side of the traction sheave 5 to the elevator car 1, to the fixing point in connection with which elevator car the second end of the traction member 7*b* is fixed.

The contact surface of the traction sheave 5 is so wide that both the traction members 7*a*, 7*b* fit side-by-side onto the contact surface of the traction sheave 5 without interfering with each other. In this way one and the same hoisting machine of a machine station 6 and also one and the same traction sheave 5 give to both the traction members 7*a*, 7*b* a force producing linear movement of the elevator car 1 and of the compensating weights 2*a*, 2*b*. A second alternative is a structural solution, in which the same traction shaft has two parallel traction sheaves 5.

FIG. 4 also presents fixing plates 9*b* functioning as the fixing means of a machine station 6, which fixing plates are fixed e.g. with screw fixings to the base plate 9*e* of the machine station 6 at both ends of the machine station 6. The fixing plates 9*b* have in the outer ends fixing holes, via which the machine station 6 is fixed at its ends to the brackets 8 via screws 9*d* functioning as fixing means and via insulation means 9*c* that damp sound and vibration. In this way there are at least fixing points in the machine station 6 and means for fixing the traction sheave 5 of the elevator, the motor 5*a* and the diverting pulleys 13-16 of the traction members 7*a*, 7*b* into their position essentially precisely in relation to each other.

As can be seen from FIG. 4, the machine station 6 itself does not in this embodiment rest on the floor of the elevator hoistway, but instead on the walls of the elevator hoistway or on other corresponding supporting structures, and the screws 9*d*, onto the support of which the machine station can be temporarily lowered, are off the floor in the machine station 6 when said station is fixed into its position. On the other hand, a flexible, e.g. spring-action, support element 5*d* is disposed below the motor 5*a*, with which support element the torsion produced by the mass of the motor 5*a* in the frame beams 9 of the machine station 6 is, if necessary, compensated.

FIGS. 5 and 6 present an oblique top view and from two different directions from the side of a machine station 6 according to the invention, with brackets 8, fixed into its position in the bottom part of the elevator hoistway. In this embodiment there is a separate base plate 1*b* on the bottom of the hoistway, which base plate reinforces the bottom of the hoistway, but the solution according to the invention functions well also without a separate base plate. The brackets 8 of the machine station 6 are composed of at least e.g. a support part 8*a* of the machine station, a wall bracket 8*b* of the bracket 8 and, in addition, a fixing part 8*c* of the guide rail 11 of the car, said fixing part to be fixed to the support part 8*a* of the machine station and comprising a plurality of fixing holes 8*d* of the guide rail 11 of the car that are precisely situated in the correct positions, which fixing holes function as the fixing points of the guide rail 11. The brackets 8 and their parts 8*a*-8*d* are made to precisely the correct dimensions and shapes, which enables the position of the brackets 8, and thereby of the whole machine station 6 as well as of the other elevator structures above the machine station 6, in the elevator hoistway in relation to the layout of the elevator to be determined directly according to the exact location position of the car guide rails 11 by fixing the brackets 8 to the car guide rails 11. The fixing holes 8*d* in the fixing part 8*c* of a car guide rail 11 form precise fixing points for the car guide rails 11, in which case the same brackets 8 and fixing parts 8*c* can be used in all elevator hoistways, even if the compensating weights 2*a*, 2*b* in different hoistways were of different widths.

FIG. 7 presents a simplified side view of one frame beam 9 of the frame part of a machine station 6, the base part 9*e* with the fixing plates 9*b* and the fixing means 9*d* and the fixing insulations 9*c* of the machine station. The frame beam 9 is e.g. a metal plate reinforced with bendings, in the center part of which beam is an opening 9*f* that is almost the height of the frame beam 9 and is open at the top, at the point of which opening the fixing plates 10 of the motor and the motor 5*a* with machine can be disposed. In addition, the frame beam 9 comprises a plurality of fixing holes 9*g* for fixing the fixing plates 10 of the motor to the frame beam 9 and holes 9*h* in the ends of the frame beam 9 for the shafts of the diverting pulleys 13 and 15. The shafts of the diverting pulleys 14 and 16 and of the traction sheave 5 are fitted in connection with the fixing plates 10 of the motor.

FIG. 8 presents a top view of one end of the frame part of a machine station 6 and the fixing plate 9*b* of the machine station 6 with the fixing means 9*d* and fixing insulations 9*c* of the machine station 6. The fixing plates 9*b* are fixed at the fixing holes 9*i* to the base part 9*e* of the machine station 6 e.g. by the aid of screws 9*j*, one of which screws is removed in FIG. 8.

FIG. 8*a* presents a top view of the fixing plate 9*b*, without fixing means, of the machine station 6 presented in FIG. 8. For fixing the machine station 6 to the brackets 8 the outer end of the fixing plate 9*b* has a first round fixing hole 9*k* and a second elongated fixing hole 9*k*, via which holes the machine station 6 is fixed to the brackets 8 by the aid of bolts and nuts functioning as fixing means 9*d*. When fixing the machine station 6 to a bracket 8 the round hole 9*k* is situated at the point of the corresponding round hole in the bracket 8, which is disposed in such a way that the aforementioned hole in the bracket and the round hole 9*k* function as a hinge point at the point of the center point of the cross-section of the traction member 7*a*, 7*b* ascending to the compensating weight 2*a*, 2*b*. Correspondingly, the elongated hole 9*m* of the fixing part allows a change in the angle of the fixing of the machine station 6 with different widths of the elevator hoistway.

FIGS. 9 and 10 present a guide rail bracket 17 to be disposed higher up in the elevator hoistway to be used in the fixing arrangement according to the invention. The guide rail bracket 17 is a bracket fabricated e.g. from one metal plate by bending and otherwise machining, the first end of which bracket comprises an essentially planar fixing part 18 with fixing holes 19 for the guide rails 11 of the elevator car 1. Correspondingly, the second end of the guide rail bracket 17 is configured to form a mounting base 20 for the guide rails of the compensating weight. The mounting base 20 comprises a first essentially planar fixing part 21 and a second essentially planar fixing part 22 for the guide rails of the compensating weight, which fixing parts 21, 22 are essentially in the same direction as each other. The fixing parts 21, 22 are rigidly connected to each other with the back part 23 of the guide rail bracket 17, which back part is essentially orthogonal to the plane of the fixing parts 21, 22. The fixing parts 21, 22 have fixing holes 24 for fixing the guide rails of the compensating weight to the guide rail bracket 17 and, in addition, the fixing part 22 has, if necessary, extra fixing holes for fixing a separate wall bracket 25 to the second end of the guide rail bracket 17. A guide rail bracket 17 is fixed by means of a wall bracket 25 e.g. to the wall of the elevator hoistway. The wall bracket 25 correspondingly has elongated fixing holes 26, by means of which the wall bracket 25 can be fixed to a suitable location in a manner allowing adjustment, both to the guide rail bracket 17 and to the wall of the elevator hoistway or corresponding fixing location. In addition, the mounting base 20 of the guide rail bracket 17 has fixing holes 20*a* for the cover plate 29 presented in FIG. 10.

FIG. 10 presents a top view of a compensating weight 2*a*, which is drawn with a dot-and-dash line, a detached cover plate 29 to be disposed in front of the path of travel of the compensating weight 2*a* and to be fixed to the guide rail bracket 17, and a guide rail bracket 17 to be used in the fixing arrangement according to the invention provided with the guide rails 11 of the elevator car 1.

FIG. 11 presents three guide rail brackets 17, as viewed from the direction of the side wall of the elevator hoistway, in their position and a part of both the compensating weight guide rails 27 and of the guide rails 11 of the car 1 of the elevator. The compensating weights are not presented in FIG. 11, but a cover plate 29 is fixed in front of the guide rails 27 of the compensating weight, between the guide rails 27 and the elevator car 1, which cover plate is fixed e.g. at both ends to the fixing holes 20*a* of the mounting base 20 of the guide rail bracket 17. The cover plate 29 functions as a protective plate e.g. when an elevator fitter or service person is in the elevator hoistway and drives the elevator. Likewise, the cover plate 29 functions as a noise-damping restraint when installed at a point in which the elevator car 1 and the compensating weights 2*a*, 2*b* meet in the elevator hoistway.

In the fixing arrangement according to the invention the shape and dimensioning of the guide rail brackets 17, as well as the manufacturing tolerances and the positions and dimensioning of the fixing holes 24 in the guide rail brackets 17 as well as of the fixing holes of the compensating weight guide rails 27, are configured to be such that the position of the compensating weight guide rails 27 is ready in the guide rail brackets 17 to a sufficient degree of accuracy and by fixing the guide rail brackets 17 to the guide rails 11 of the elevator car 1 on a fixing point for the guide rail 11, the compensating weight guide rails 27 can be fixed sufficiently precisely into their position without separate plumbing, because it is sufficient that only the guide rails 11 of the elevator car 1 are plumbed. In this case the location of the compensating weight guide rails 27 with respect to the guide rail 11 of the elevator car 1 and the distance between the compensating weight guide rails 27 are determined by the shape, dimensioning, fixing holes and manufacturing tolerances of the guide rail bracket 17, and the whole fixing arrangement can be conceived as seeking its guidance according to the guide rail line of the guide rails 11 of the elevator car 1. The guide rail bracket 17 comprises means for fixing the guide rail bracket 17 to the guide rail of the elevator car 1 and for fixing the compensating weight guide rails 27 to the guide rail bracket 17 in such a way that when fixing the guide rail bracket 17 to the guide rail 11 of the elevator car 1 the precise location of the compensating weight guide rails 27 are simultaneously determined.

In the fixing arrangement according to the invention the traction member 7*a*, 7*b* can be either a plurality of parallel hoisting ropes, a chain or a belt, e.g. a toothed belt. What all the solutions presented have in common is that the traction members 7*a*, 7*b* are fixed at one of their ends, e.g. their ends on the elevator car 1 side, with fixing means 1*a* providing a spring force or a constant-tensioning force such that a traction member 7*a*, 7*b* always remains sufficiently taut on the rim of the traction sheave 5 and that when the suspension members 3 of the elevator car 1 stretch and loosen the fixing means 1*a* remove the elongation produced via the traction members 7*a*, 7*b* and the suspension of the suspension members 3 compensates the elongation by keeping the elevator car 1 always on an even bearing.

In the fixing arrangement according to the invention the supporting of the elevator car 1 is separated from the moving means of the elevator car and smart materials, such as toothed belts, in which traction is not based on friction but instead on shape-locking, preferably suited to the purpose are used as the moving means, i.e. as the traction members 7*a*, 7*b*. Since the traction is not based on friction and elongations of the suspension members 3 can easily be compensated, one or more compensating weights 2*a*, 2*b* can be used instead of counterweights, which compensating weights are disposed in the elevator hoistway space-efficiently in relation to the cross-section of the elevator hoistway and their mass is optimized according to the use of the elevator such that the elevator arrangement is made to function in the best possible way in relation to energy efficiency in exactly the use for which it has been delivered. The aforementioned space efficiency can be further improved with traction sheaves and diverting pulleys that are small in diameter and that can be disposed in a small space.

What is further characteristic for the fixing arrangement according to the invention is that the point of location on the elevator car 1 of the diverting pulleys 4*a*-4*d* disposed on the elevator car is configured in such a way that the elevator car 1 can rise past the diverting pulleys 4 in the top end of the hoistway right to the top end of the hoistway. In this way the most space-efficient layout solution possible is achieved in the top end of the hoistway.

It is obvious to the person skilled in the art that the invention is not limited solely to the examples described above, but that it may be varied within the scope of the claims presented below. Thus, for example, the suspension solutions can be different to what is presented above.

It is also obvious to the person skilled in the art that the number of compensating weights can also be greater than one or two. There can be e.g. three, four, six, eight, ten or even more compensating weights disposed in a different manner.

A person skilled in the art will understand that the traction members and the suspension members can be arranged otherwise than what is presented in the embodiments. Likewise, the fixings of the traction members to the elevator car or to the compensating weight and the fixings of the suspension members to the elevator car or to the compensating weight can differ to what is presented.

It is also obvious to the person skilled in the art that the shape and the structure of the machine station, of the brackets of the machine station and of the guide rail brackets presented may also differ from what is presented above.

The invention claimed is:

1. An apparatus configured to fix a hoisting machine in an elevator, the elevator including an elevator car and one or more counterweights or compensating weights, the elevator car configured to move reciprocally in an elevator hoistway, the one or more counterweights or compensating weights configured to support the elevator car via one or more support members and a plurality of diverting pulleys associated with the one or more support members, the hoisting machine including one or more traction sheaves and one or more traction members configured to transfer rotational movement of the one or more traction sheaves into movement of the elevator car guided by elevator car guide rails and into movement of the one or more counterweights or compensating weights guided by counterweight guide rails or compensating weight guide rails, the apparatus comprising:

a machine station configured to arrange the one or more traction sheaves, a motor, and a plurality of diverting pulleys associated with the one or more traction members into a particular configuration of positions relative to each other; and a plurality of brackets configured to fix the machine station into a position that is determined by a position of the elevator car guide rails in the elevator hoistway, the plurality of brackets including top surfaces, the top surfaces including buffers for the one or more counterweights or compensating weights.

2. The apparatus according to claim 1, wherein ends of the machine station are fixed to respective ones of the plurality of brackets;

the plurality of brackets are fixed to respective fixing parts of an elevator car guide rail, among the elevator car guide rails, at fixing points; and the fixing points are positioned such that when the plurality of brackets are fixed to the respective fixing parts, the one or more traction sheaves, the motor and the plurality of diverting pulleys for the one or more traction members are located at their final position.

3. The apparatus according to claim 1, wherein the machine station is detachably-fixed to a floor of the elevator hoistway via the plurality of brackets.

4. The apparatus according to claim 1, wherein the machine station is fixed to at least one element of a counterweight guide rail from among the counterweight guide rails;

a compensating weight guide rail from among the compensating weight guide rails;

an elevator car guide rail from among the elevator car guide rails; and a wall of the elevator hoistway.

5. The apparatus according to claim 1, further comprising:

fixing plates configured to fix ends of the machine station to respective brackets at the ends of the machine station, an outer end of the fixing plates having a first round fixing hole and a second elongated fixing hole, wherein when fixing the machine station to a respective bracket, the first round fixing hole is configured to be positioned at a corresponding round hole in the respective bracket such that the corresponding round hole in the respective bracket and the first round fixing hole function as a hinge point at a center point of a cross-section of a traction member, among the one or more traction members, ascending to the one or more counterweights or compensating weights.

6. The apparatus of claim 1, wherein the one or more support members are ropes or belts.

7. The apparatus of claim 1, wherein the one or more traction members are belts, ropes or chains.

8. A fixing arrangement configured to fixing a hoisting machine in an elevator, the elevator including an elevator car and one or more counterweights or compensating weights, the elevator car configured to move reciprocally in an elevator hoistway, the one or more counterweights or compensating weights supporting the elevator car via one or more support members and a plurality of diverting pulleys, wherein the hoisting machine including one or more traction sheaves and one or more traction members configured to transfer rotational movement of the one or more traction sheaves into movement of the elevator car guided by elevator car guide rails and into movement of the one or more counterweights or compensating weights guided by counterweight guide rails or compensating weight guide rails, the fixing arrangement comprising:

a machine station configured to arrange the one or more traction sheaves, a motor and a plurality of diverting pulleys associated with the one or more traction members into a particular configuration of positions relative to each other;

a plurality of brackets configured to fix the machine station into a final position, the final position of the machine station being determined by a position of the elevator car guide rails in the elevator hoistway; and a plurality of guide rail brackets arranged in an upper part of the elevator hoistway, the plurality of guide rail brackets including fixing parts for the elevator car guide rails and fixing parts for the counterweight guide rails or compensating weight guide rails, wherein a first end of a guide rail bracket, among the plurality of guide rail brackets, is fixed to an elevator car guide rail, among the elevator car guide rails, and the fixing arrangement further includes a wall bracket configured to fix a second end of the guide rail bracket to a fixing point in the elevator hoistway, and a cover plate fixed to at least two of the plurality of guide rail brackets arranged in a vertical direction between the elevator car and the one or more counterweights or compensating weights.

9. The fixing arrangement according to claim 8, wherein ends of the machine station are fixed to respective ones of the plurality of brackets;

the plurality of brackets are fixed to respective fixing parts of an elevator car guide rail, among the elevator car guide rails, at fixing points; and the fixing points are positioned such that when the plurality of brackets are fixed to the respective fixing parts, the one or more traction sheaves, the motor and the plurality of diverting pulleys for the one or more traction members are located at their final position.

10. The fixing arrangement according to claim 8, wherein the machine station is at least one of detachably-fixed to a floor of the elevator hoistway via brackets;

fixed to a wall of the elevator hoistway; and fixed to some other supporting structure.

11. The fixing arrangement according to claim 8, wherein the plurality of guide rail brackets include fixing holes; and a shape and dimensioning of the plurality of guide rail brackets and manufacturing tolerances and positions and dimensioning of fixing holes in the plurality of guide rail brackets and fixing holes of the counterweight guide rails or compensating weight guide rails, are configured such that the counterweight guide rails or compensating weight guide rails are arranged in their final position when the plurality of guide rail brackets are fixed to the elevator car guide rails.

12. The fixing arrangement according to claim 11, wherein a location of the counterweight guide rails or compensating weight guide rails with respect to the elevator car guide rails and a distance between the counterweight guide rails or compensating weight guide rails is determined by the shape, dimensioning, fixing holes and manufacturing tolerances of the plurality of guide rail brackets; and the fixing arrangement is configured to be guided according to a guide rail line of the elevator car guide rails.

13. The fixing arrangement of claim 8, wherein the one or more support members are ropes or belts.

14. The fixing arrangement of claim 8, wherein the one or more traction members are belts, ropes or chains.

15. An apparatus configured to fix a hoisting machine in an elevator, the elevator including an elevator car and one or more counterweights or compensating weights, the elevator car configured to move reciprocally in an elevator hoistway, the one or more counterweights or compensating weights configured to support the elevator car via one or more support members and a plurality of diverting pulleys associated with the one or more support members, the hoisting machine including one or more traction sheaves and one or more traction members configured to transfer rotational movement of the one or more traction sheaves into movement of the elevator car guided by elevator car guide rails and into movement of the one or more counterweights or compensating weights guided by counterweight guide rails or compensating weight guide rails, the apparatus comprising:

a machine station configured to arrange the one or more traction sheaves, a motor and a plurality of diverting pulleys associated with the one or more traction members into a particular configuration of positions relative to each other; and fixing plates to fix ends of the machine station to respective brackets at the ends of the machine station, an outer end of the fixing plates having a first round fixing hole and a second elongated fixing hole, wherein when fixing the machine station to a respective bracket, the first round fixing hole is configured to be positioned at a corresponding round hole in the respective bracket such that the corresponding round hole in the respective bracket and the first round fixing hole function as a hinge point at a center point of a cross-section of a traction member, among the one or more traction members, ascending to the one or more compensating weights.

16. The apparatus of claim 15, wherein the machine station includes a plurality of brackets configured to fix the machine station into position, the position being determined by a position of the elevator car guide rails in the elevator hoistway, the plurality of brackets including top surfaces including buffers for the one or more counterweights or compensating weights.

17. The apparatus of claim 15, wherein the one or more traction members are belts, ropes or chains.

18. An apparatus configured to fix a hoisting machine in an elevator, the elevator including an elevator car and one or more counterweights or compensating weights, the elevator car configured to move reciprocally in an elevator hoistway, the one or more counterweights or compensating weights configured to support the elevator car via one or more support members and a plurality of diverting pulleys associated with the one or more support members, the hoisting machine including one or more traction sheaves and one or more traction members configured to transfer rotational movement of the one or more traction sheaves into movement of the elevator car guided by elevator car guide rails and into movement of the one or more counterweights or compensating weights guided by counterweight guide rails or compensating weight guide rails, the apparatus comprising:

a machine station configured to arrange the one or more traction sheaves, a motor and a plurality of diverting pulleys associated with the one or more traction members into a particular configuration of positions relative to each other, wherein the one or more support members are ropes or belts.

19. The apparatus of claim 18, wherein the machine station includes a plurality of brackets configured to fix the machine station into position, the position being determined by a position of the elevator car guide rails in the elevator hoistway, the plurality of brackets including top surfaces including buffers for the one or more counterweights or compensating weights.

20. The apparatus of claim 18, wherein the machine station includes fixing plates to fix ends of the machine station to respective brackets at the ends of the machine station, an outer end of the fixing plates having a first round fixing hole and a second elongated fixing hole, wherein when fixing the machine station to a respective bracket, the first round fixing hole is configured to be positioned at a corresponding round hole in the respective bracket such that the corresponding round hole in the respective bracket and the first round fixing hole function as a hinge point at a center point of a cross-section of a traction member, among the one or more traction members, ascending to the one or more compensating weights.

* * * * *